US005478203A

United States Patent [19]

Barker et al.

[11] Patent Number: 5,478,203

[45] Date of Patent: Dec. 26, 1995

[54] BLADE PITCH CHANGE MECHANISM

[75] Inventors: David R. Barker, Burton-on-Trent; Edward S. Hadaway, Duffield, both of England

[73] Assignee: Rolls-Royce PLC, London, England

[21] Appl. No.: 422,258

[22] Filed: Apr. 14, 1995

[30] Foreign Application Priority Data

Apr. 28, 1994 [GB] United Kingdom ..... 9408476

[51] Int. Cl.[6] ..... B63H 3/00

[52] U.S. Cl. ..... 416/147; 416/151

[58] Field of Search ..... 416/147, 151, 416/155, 160

[56] References Cited

U.S. PATENT DOCUMENTS

| | | | |
|---|---|---|---|
| 3,459,267 | 8/1969 | Chilman | 416/147 |
| 4,578,019 | 3/1986 | Safarik . | |
| 4,692,093 | 9/1987 | Safarik . | |
| 4,878,809 | 11/1989 | Ames | 416/151 |
| 4,890,979 | 1/1990 | Ames et al. | 416/160 |
| 5,090,869 | 2/1992 | Wright | 416/147 |
| 5,174,716 | 12/1992 | Hora et al. . | |
| 5,205,712 | 4/1993 | Hamilton | 416/160 |
| 5,242,265 | 9/1993 | Hora et al. | 416/160 |
| 5,281,095 | 1/1994 | Komura et al. | 416/147 |

FOREIGN PATENT DOCUMENTS

| | | |
|---|---|---|
| 546995 | 8/1942 | United Kingdom . |
| 2186918 | 8/1987 | United Kingdom . |
| 2197912 | 6/1988 | United Kingdom . |

*Primary Examiner*—John T. Kwon
*Attorney, Agent, or Firm*—Oliff & Berridge

[57] ABSTRACT

A pitch change mechanism for a plurality of fan blades (12) comprises adjustment device (60) to rotate the blades (12) about their longitudinal axes. A gear box (34) provides rotary power to drive the adjustment device (60) in response to a control signal. The gear box (34) is mounted in the fan shaft (30) and rotates therewith. An input shaft (33) to the gear box (34) is mechanically connected to a turbine shaft (32) so that the input shaft (33) rotates with the turbine shaft (32). The difference between the speeds of the fan shaft (30) and the turbine shaft (32) is used to drive an output shaft (39) of the gear box (34). The rotary power of the output shaft (34) drives the pitch adjustment device (60) via a plurality of gears (50).

10 Claims, 3 Drawing Sheets

BLADE PITCH CHANGE MECHANISM

The present invention relates to a mechanism for changing the pitch of a plurality of blades mounted on a rotating shaft of an engine. More particularly the present invention relates to apparatus for changing the pitch of a plurality of fan blades of a gas turbine engine.

Pitch adjustment of the fan blades of a gas turbine engine may be used to optimise the efficient operation of the engine throughout its flight envelope or to provide reverse thrust on landing. Conventional pitch change mechanisms are derived from propeller installations where continual changes of pitch are required during flight. These mechanisms are mainly driven by hydraulic or electrical power supplied from a source external to the engine or generated locally to the pitch change mechanism.

providing either hydraulic or electrical power from an external source results in extra lines through the engine and requires means for transferring high hydraulic pressure or a large flow of electrical power from static to rotating parts. Generation of the required power locally to the pitch change mechanism on the rotating part of the engine also requires additional parts in the form of a hydraulic pump or electrical generator. All of this results in additional cost, weight and maintenance.

With a turbo-fan engine it may only be necessary to select a limited number of fan pitch settings, for example, at take-off, cruise and reverse thrust, requiring only intermittent operation of the mechanism for short periods of time in the flight cycle. Furthermore with a turbo-fan it is sometimes necessary to inspect blades in situ and replace individual ones. This can be difficult due to the relative close positioning of the blades but the problem can be eased by varying the pitch setting. With conventional pitch change mechanisms this may require running the engine making fan maintenance time consuming and expensive.

The present invention seeks to provide a simplified and lighter pitch change mechanism suitable for intermittent operation but which can be operated, for fan maintenance purposes, without the need to run the engine.

According to the present invention a pitch change mechanism for a plurality of blades mounted in a first rotor for rotation about their longitudinal axes, a first drive shaft being provided for rotating the first rotor, there being further provided a second rotor and a second drive shaft for rotating the second rotor at a different speed to the first rotor, the ratio of the speeds of the first and second rotors is fixed, the pitch change mechanism comprises adjustment means to rotate the blades of the first rotor about their longitudinal axes and a gear box which provides rotary power to the adjustment means in response to a control signal, the gear box being mounted to rotate with the first shaft and a mechanical connection with the second shaft providing an input drive to the gear box, the gear box using the difference between the speeds of the two shafts to drive an output shaft which provides rotary power to drive the adjustment means.

preferably the mechanical connection with the second shaft is a further shaft coupled to the second shaft so that the further shaft rotates with the second shaft to provide an input drive to the gear box. The further shaft may be coupled to the second shaft by an at least one splined joint.

The gear box may include clutch means which selectively engages the output shaft in response to the control signal to provide intermittent operation of the pitch change mechanism preferably the gear box is further provided with means to rotate the output shaft in either direction.

The adjustment means is preferably a plurality of levers, a lever being attached to each of the blades so that movement of the levers causes the blades to rotate about their longitudinal axes. The levers may be attached to a carriage mounted on a ballscrew having a recirculating ball thread, translation of the carriage along the ballscrew moving the levers so as to rotate the blades about their longitudinal axes.

The control signal may be an electrical signal which is generated automatically by an engine electronic control system.

In the preferred embodiment of the present invention the pitch change mechanism is for use with fan blades of a gas turbine engine. Preferably the gear box is mounted in the fan shaft and the fan shaft is driven by a turbine shaft through a reduction gear box.

The invention will now be described with reference to the accompanying drawings in which.

Figure 1:
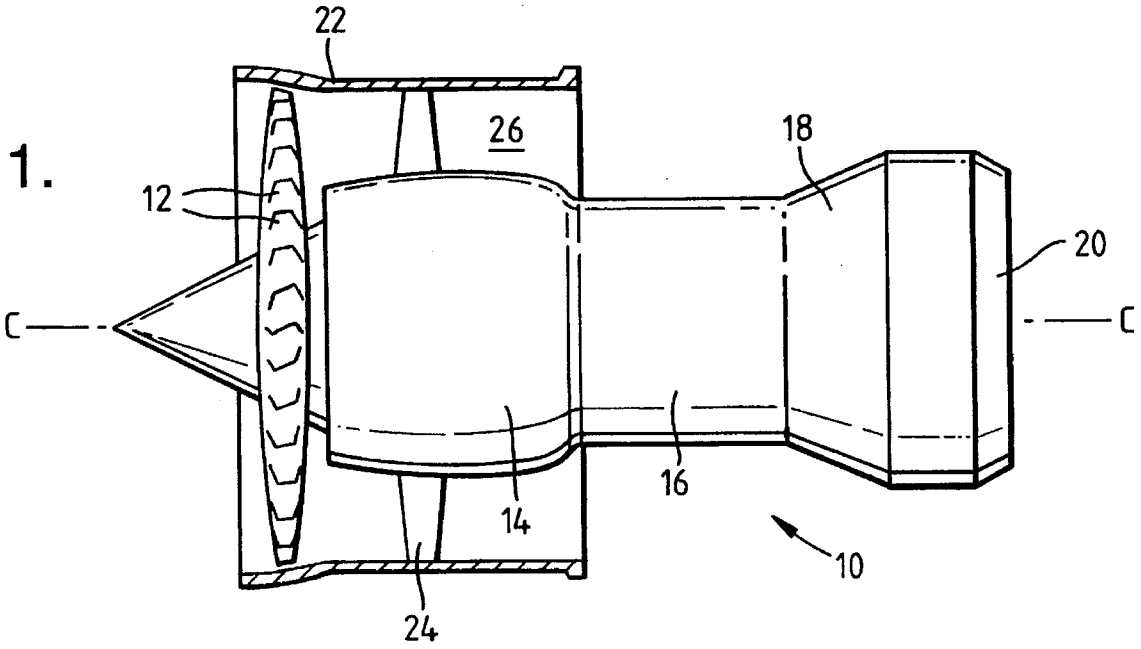
FIG. 1 is a diagrammatic view of a gas turbine engine having a pitch change mechanism in accordance with the present invention.

Referring to FIG. 1 a gas turbine ducted fan engine, generally indicated at 10, comprises a core gas turbine engine having a stage of fan blades 12 at its upstream end. A cowl 22 is spaced from the core engine by struts 24 to define an annular duct 26, known as a bypass duct. A flow of air from the fan blades 12 is divided so that a proportion flows through the bypass duct 26 and a proportion passes through the core engine. The core engine operates in conventional manner so that the air is compressed by compressor section 14 before being mixed with fuel and the mixture combusted in a combustor 16. The hot combustion gases then expand through turbine section 18 which drives the compressor section 14 and the fan 12 before exhausting through an exhaust nozzle 20.

Figure 2:
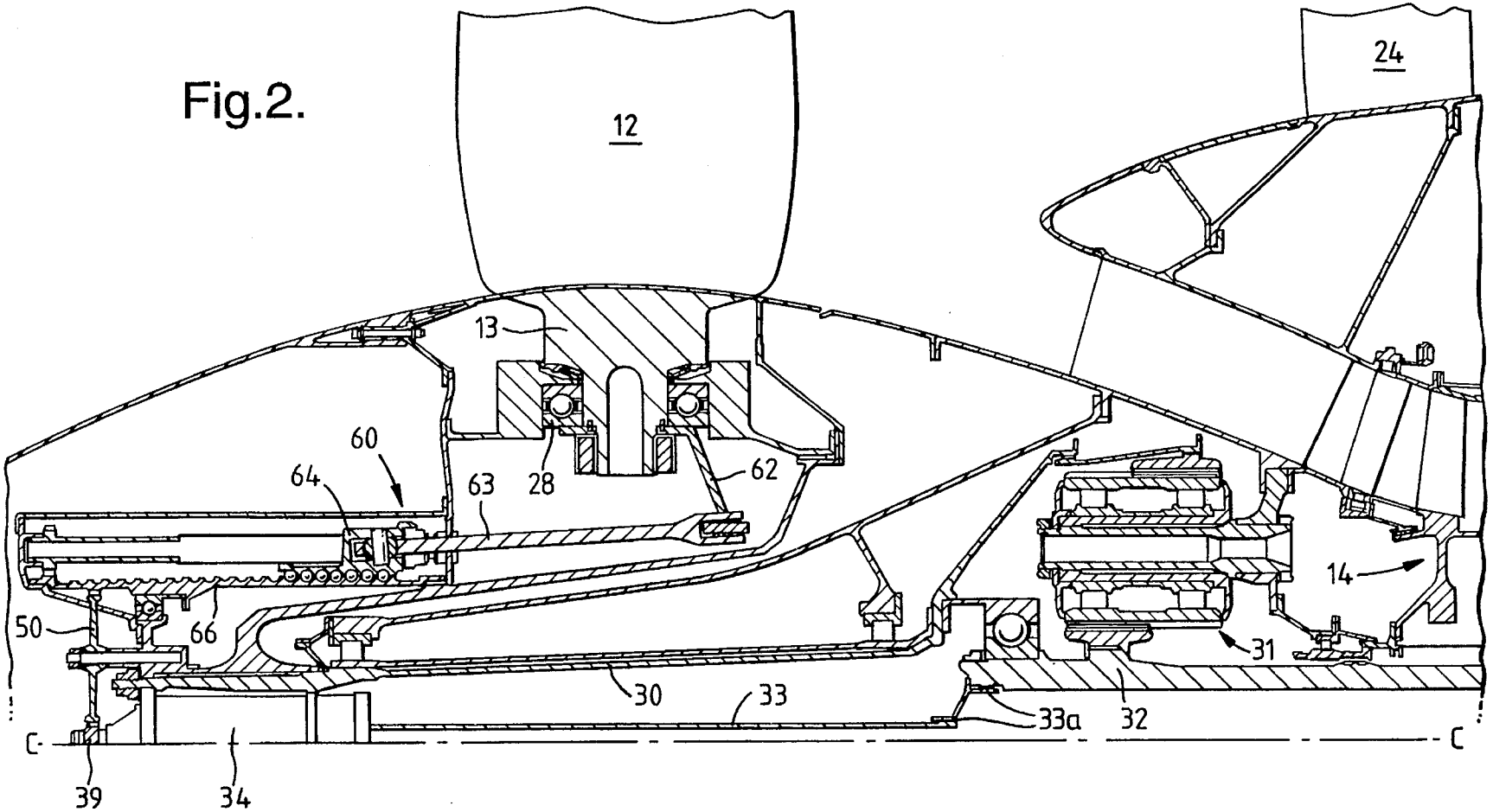
FIG. 2 is a partially sectioned view along the centre line c—c of part of the gas turbine engine shown in FIG. 1.

The fan blades 12 are rotated by a fan shaft 30, FIG. 2. The fan shaft 30 is driven by a turbine shaft 32 through reduction gearing 31. The fan shaft 30 rotates in the opposite direction to the turbine shaft 32.

The root portions 13 of the fan blades 12 are mounted on ball bearings 28 so that the fan blades 12 rotate about their longitudinal axes to vary their pitch. The pitch of the fan blades 12 is adjusted during flight to achieve efficient operation of the engine 10.

Figure 3:
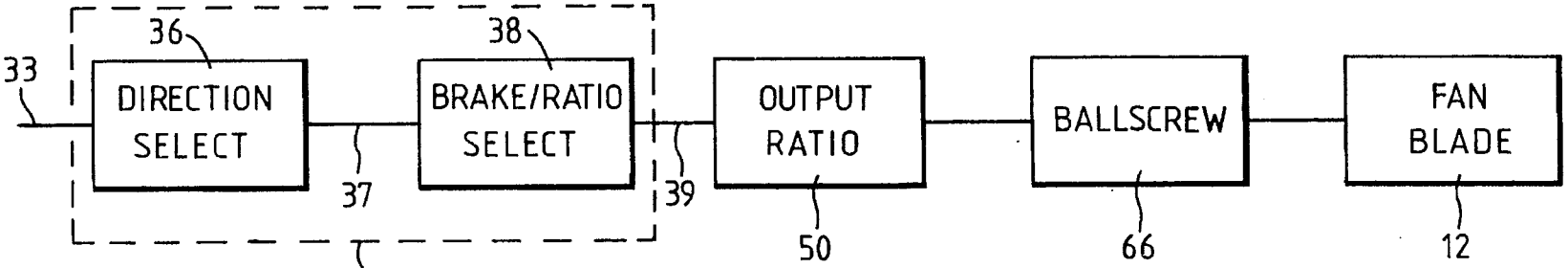
FIG. 3 is a block diagram of a pitch change mechanism in accordance with the present invention.

Referring to FIG. 3 the pitch change mechanism comprises pitch adjustment means 60 to vary the pitch of the fan blades 12. A gear box 34 controls the pitch adjustment means 60 in response to a pitch control signal. The pitch control signal is an electrical signal generated automatically by an electronic engine control system (not shown) in response to a rotational speed of the engine 10.

The gear box 34 has a direction select section 36 and a brake/ratio select section 38. The direction select section 36 allows the pitch of the fan blades 12 to be adjusted in either direction, by controlling the direction of rotational force or power provided to the adjustment means 60. The brake/ratio section 38 allows the adjustment means 60 to be driven at pre-set rates by controlling the rotational speed of that rotational force or power.

The gear box 34 is mounted in the fan shaft 30, FIG. 2, and rotates therewith. An input shaft 33 to the gear box 34 is mechanically connected to the turbine shaft 32. The input shaft 33 to the gear box 34 is coupled, by splined joints 33a, to the turbine shaft 32 so that the input shaft 33 rotates with the turbine shaft 32. The difference between the speeds of the fan shaft 30 and the turbine shaft 32 is used to drive an output shaft 39 of the gear box 34. The rotary power of the output shaft 39 is converted to the correct output ratio by gears 50 which drive the pitch adjustment means 60.

Figure 4:
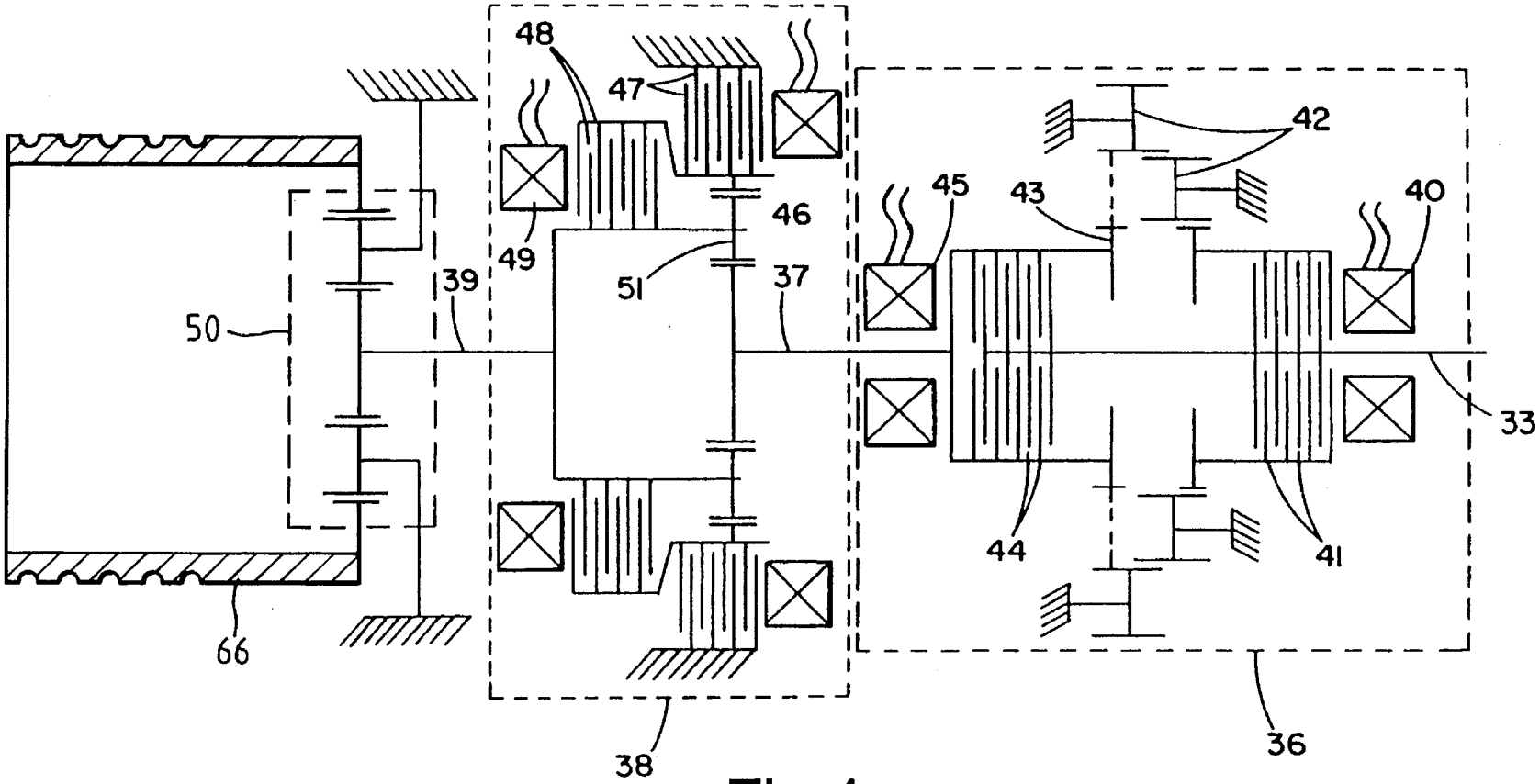
FIG. 4 is a schematic view of a pitch controller for use in a pitch change mechanism in accordance with the present invention.

When the pitch of the blades 12 is to be changed an electrical signal from the electronic engine control system is sent to the gear box 34. The electrical signal energises one of the solenoids, 40 or 45, in the direction select section 36 of the gear box 34 and one of the solenoids, 46 or 49, in the brake/ratio select section 38 of the gear box 34 (FIG. 4).

When solenoid 40 is energised clutch plates 41 engage to connect the input shaft 33 with idler gears 42 which are driven by the fan shaft 30. The idler gears 42 move to connect with a ring gear 43 and drive intermediate shaft 37 in the opposite direction to the input shaft 33.

Alternatively if solenoid 45 is energised clutch plates 44 engage to drive intermediate shaft 37 in the same direction as the input shaft 33. The intermediate shaft 37 drives the brake/ratio section 38 of the gear box 34.

In the embodiment shown, clutch plates 48 and 47 are normally engaged, locking the output shaft 39. When solenoid 49 is energized, clutch plates 48 disengage, brake 47 remains engaged, the speed of the output shaft 39 is reduced by a gear ratio of, for example 3.6:1, through planet gears 51 mounted within the ring gear connected to the brake 47.

Alternatively, when solenoid 46 is energised, brake 47 disengages, clutch plates 48 remain engaged and a gear ratio of 1:1 is selected. Thus this mechanism permits the speed of the rotational power output to be selected from at least two different speeds. In this way, coarse and fine adjustments of the blade pitch can be achieved at variable rates.

The speed of the output shaft 39 is further reduced by the planet gears 50. The planet gears 50 give the required output ratio to drive the pitch adjustment means 60.

The pitch adjustment means 60 comprises a plurality of levers 62. One end of each of the levers 62 is attached to the root 13 of a blade 12. The other end of each of the levers 62 is attached to a rod 63 connected to a carriage 64 mounted on a ballscrew 66. The ballscrew 66 has a recirculating ball thread which allows the carriage 64 to move along the ballscrew 66. The rotary power from the output shaft 39 of the gear box 34 rotates the ballscrew 66 so that the carriage 64 moves along the ballscrew 66. Translation of the carriage 64 along the ballscrew 66 causes the levers 62 to move and rotates the fan blades 12 about their longitudinal axes.

Once the fan blades 12 have reached the correct pitch position for a given engine speed the electronic control system switches off the solenoids 40, 45 46 and 49. The clutch plates 41 and 44 disengage so that rotary power is not transmitted to the output shaft 39, thereby reducing wear on the apparatus. The clutch plates 48 and 47 are engaged to lock the output shaft 39 and maintain the pitch setting.

A pitch controller mechanism in accordance with the present invention uses the difference between the speeds of rotation of the fan shaft 30 and the turbine shaft 32 to drive the pitch adjustment means 60. By utilising a gear box 34 between the two shafts 30 and 32 to drive the pitch adjustment means the mechanism is not dependant on a hydraulic system. The pitch of the blades 12 can therefore be changed when the engine 10 is not operational by rotating the stage of fan blades 12 by hand. This is particularly advantageous during maintenance when the pitch of the fan blades 12 needs to be changed to allow removal of the blades 12.

Although the present invention has been described with reference to a gas turbine engine 10 it will be appreciated by one skilled in the art that it is applicable to any engine having two shafts rotating at different speeds, the blades of one of the shafts requiring pitch adjustment.

We claim:

1. A pitch change mechanism for a plurality of blades mounted on a first rotor for rotation about their longitudinal axes, a first drive shaft being provided for rotating the first rotor, there being further provided a second rotor and a second drive shaft for rotating the second rotor at a different speed to the first rotor, the ratio of the speeds of the first and second rotors being fixed, the pitch change mechanism comprising adjustment means to rotate the blades of the first rotor about their longitudinal axes and a gear box which provides rotary power to the adjustment means in response to a control signal, the gear box being mounted to rotate with the first shaft and a mechanical connection with the second shaft providing an input drive to the gear box, the gear box using the difference between the speeds of the two shafts to drive an output shaft which provides rotary power to drive the adjustment means.

2. A pitch change mechanism as claimed in claim 1 in which the mechanical connection with the second shaft is a further shaft coupled to the second shaft so that the further shaft rotates with the second shaft to provide an input drive to the gear box.

3. A pitch change mechanism as claimed in claim 1 in which the gear box includes clutch means which selectively engages the output shaft in response to the control signal to provide intermittent operation of the pitch change mechanism.

4. A pitch change mechanism as claimed in claim 3 in which the gear box is further provided with means to rotate the output shaft in either direction.

5. A pitch change mechanism as claimed in claim 1 in which the adjustment means is a plurality of levers, a lever being attached to each of the blades so that movement of the levers causes the blades to rotate about their longitudinal axes.

6. A pitch change mechanism as claimed in claim 5 in the levers are attached to a carriage mounted on a ballscrew having a recirculating ball thread, translation of the carriage along the ballscrew moving the levers so as to rotate the blades about their longitudinal axes.

7. A pitch change mechanism as claimed in claim 1 in which the control signal is an electrical signal generated automatically by an engine electronic control system.

8. A pitch change mechanism as claimed in claim 1 in which the blades of the first rotor are fan blades.

9. A pitch change mechanism as claimed in claim 1 in which the first rotor is a fan which is driven by a turbine shaft through a reduction gear box.

10. A pitch change mechanism as claimed in claim 1 in which the gear box is mounted inside the first drive shaft.

* * * * *